US007418828B2

(12) United States Patent
Himori

(10) Patent No.: US 7,418,828 B2
(45) Date of Patent: Sep. 2, 2008

(54) REFRIGERATOR

(75) Inventor: Nobuaki Himori, Shiga (JP)
(73) Assignee: Matsushita Electric Industrial Co., Ltd., Osaka (JP)

( * ) Notice: Subject to any disclaimer, the term of this patent is extended or adjusted under 35 U.S.C. 154(b) by 298 days.

(21) Appl. No.: 10/595,048

(22) PCT Filed: Oct. 5, 2004

(86) PCT No.: PCT/JP2004/014997

§ 371 (c)(1),
(2), (4) Date: Jan. 17, 2006

(87) PCT Pub. No.: WO2005/036077

PCT Pub. Date: Apr. 21, 2005

(65) Prior Publication Data

US 2006/0179851 A1 Aug. 17, 2006

(30) Foreign Application Priority Data

Oct. 9, 2003 (JP) ..... 2003-350533
Oct. 9, 2003 (JP) ..... 2003-350931
Oct. 9, 2003 (JP) ..... 2003-351023

(51) Int. Cl.
*F25D 23/12* (2006.01)

(52) U.S. Cl. ..... 62/338; 62/389; 222/146.6

(58) Field of Classification Search ..... 62/337–339, 62/389–400, 441–447, 449; 222/129.1, 146.6, 222/185.1, 545, 546, 496; 220/238, 334; 137/607, 377, 382, 489, 508, 625.17, 636.2, 137/636.3, 636.4; 251/244, 246, 227, 228, 251/238, 263

See application file for complete search history.

(56) References Cited

U.S. PATENT DOCUMENTS 1,740,205 A * 12/1929 Schmidt ..... 99/446
1,918,767 A * 7/1933 Maine ..... 62/397
2,408,704 A * 10/1946 Taylor ..... 222/160
2,512,395 A 6/1950 Sundberg
2,781,153 A * 2/1957 Roberts ..... 222/183
2,894,377 A * 7/1959 Shiklers, Jr. et al. ..... 62/306
2,914,218 A * 11/1959 Korodi ..... 222/131
3,369,566 A * 2/1968 Schmitt et al. ..... 137/636.1
3,934,758 A * 1/1976 Kipp ..... 222/108
4,298,183 A * 11/1981 Kawakami ..... 251/263
5,303,849 A * 4/1994 Credle, Jr. ..... 222/129.1
5,359,795 A 11/1994 Mawby
5,683,015 A * 11/1997 Lee ..... 222/146.6
5,857,596 A 1/1999 Lee (Continued)

FOREIGN PATENT DOCUMENTS

CN 86 2 05461 U 4/1987

(Continued)

OTHER PUBLICATIONS

International Search Report of PCT/JP2004/014997.

*Primary Examiner*—Mohammad M Ali
(74) *Attorney, Agent, or Firm*—RatnerPrestia

(57) ABSTRACT

A refrigerator includes water storage tank (17) disposed at a higher place inside the door, water feeder (16) placed on a front face of the door, and water feeding tube (18) coupling tank (17) to feeder (16). Tube (18) slants upward from water feeder (16) to storage tank (17).

10 Claims, 9 Drawing Sheets

U.S. PATENT DOCUMENTS

| | | | | |
|---|---|---|---|---|
| 5,862,952 | A | 1/1999 | Lee | |
| 5,971,213 | A | 10/1999 | Lee | |
| 6,003,734 | A * | 12/1999 | Oh | 222/146.6 |
| 6,193,093 | B1 * | 2/2001 | Brunner | 220/234 |
| 6,425,425 | B2 * | 7/2002 | Bianchi et al. | 141/362 |

FOREIGN PATENT DOCUMENTS

| | | | |
|---|---|---|---|
| CN | 1170129 | | 1/1998 |
| JP | 2000-302202 | A * | 10/2000 |
| JP | 2002/115960 | A | 4/2002 |

* cited by examiner

REFRIGERATOR

This is a U.S. national phase application of PCT international application PCT/JP2004/01 4997, filed Oct. 5, 2004.

TECHNICAL FIELD

The present invention relates to a refrigerator having a water feeder at its door.

BACKGROUND ART

FIG. 9 shows a conventional refrigerator, in which pump 7 is placed on water storage tank 6 accommodated in shelf 5 disposed inside door 1. Chilled water in tank 6 is supplied from water feeder 8 (not shown) placed on the front face of the door to the outside of the refrigerator via feeding tube 9 and pump 7. The pump and its accessories occupy some place, so that a place supposed to store food is eliminated.

DISCLOSURE OF THE INVENTION

The present invention aims to provide a refrigerator that has a water feeder free from using a pump. The refrigerator of the present invention comprises the following elements:

- a water storage tank disposed at a higher place inside the door;
- a water feeder disposed on the front face of the door;
- a feeding tube coupling the water storage tank to the water feeder, having an outlet at its one end, and slanting upward from the water feeder to the water storage tank.

DETAILED DESCRIPTION OF PREFERRED EMBODIMENT OF THE INVENTION

Figure 1:
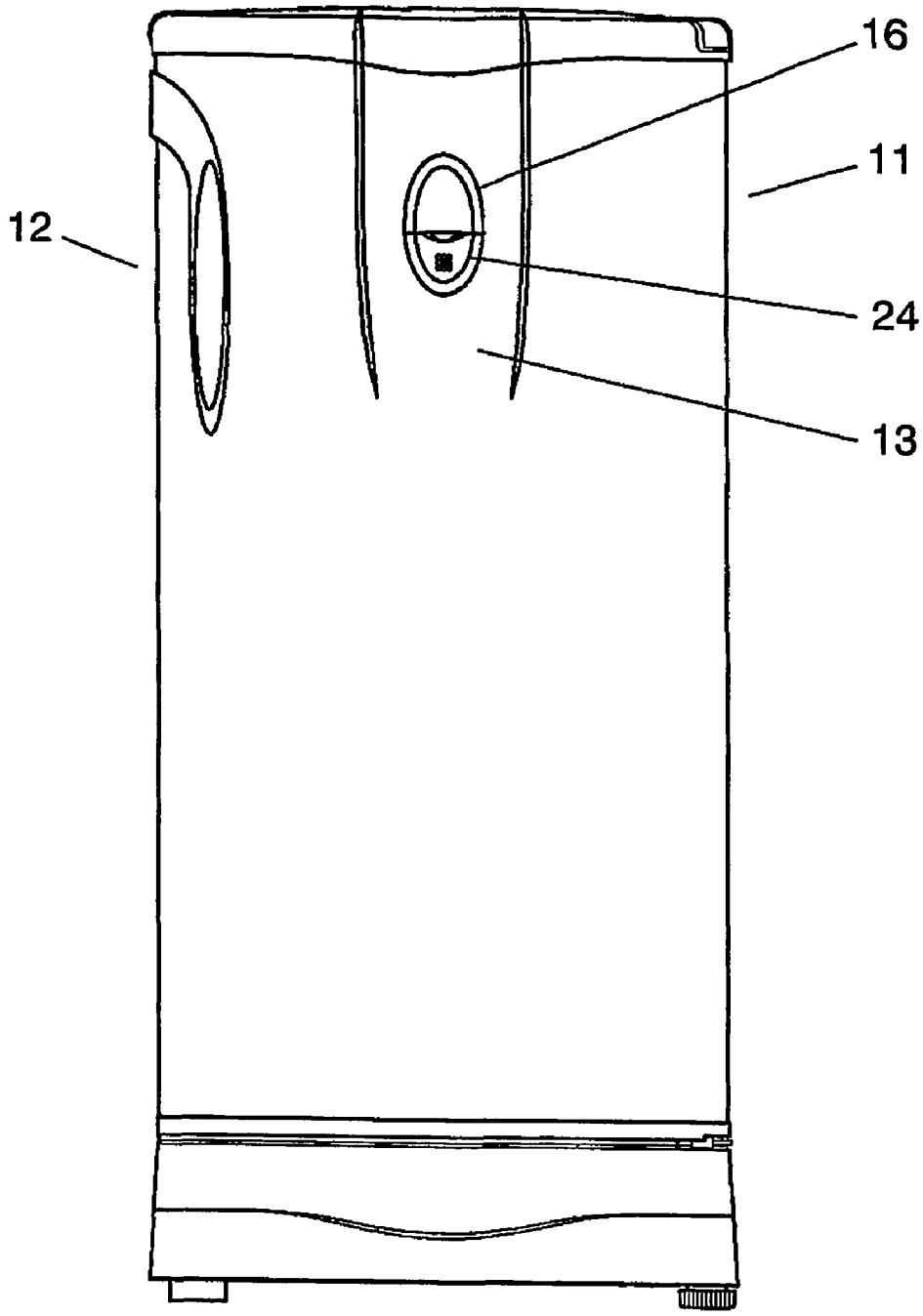
FIG. 1 shows a front view of a refrigerator in accordance with an exemplary embodiment of the present invention.

An exemplary embodiment of the present invention is demonstrated hereinafter with reference to the accompanying drawings. FIG. 1 shows a front view of a refrigerator, and FIG. 2 shows a sectional view of a water feeder.

Figure 2:
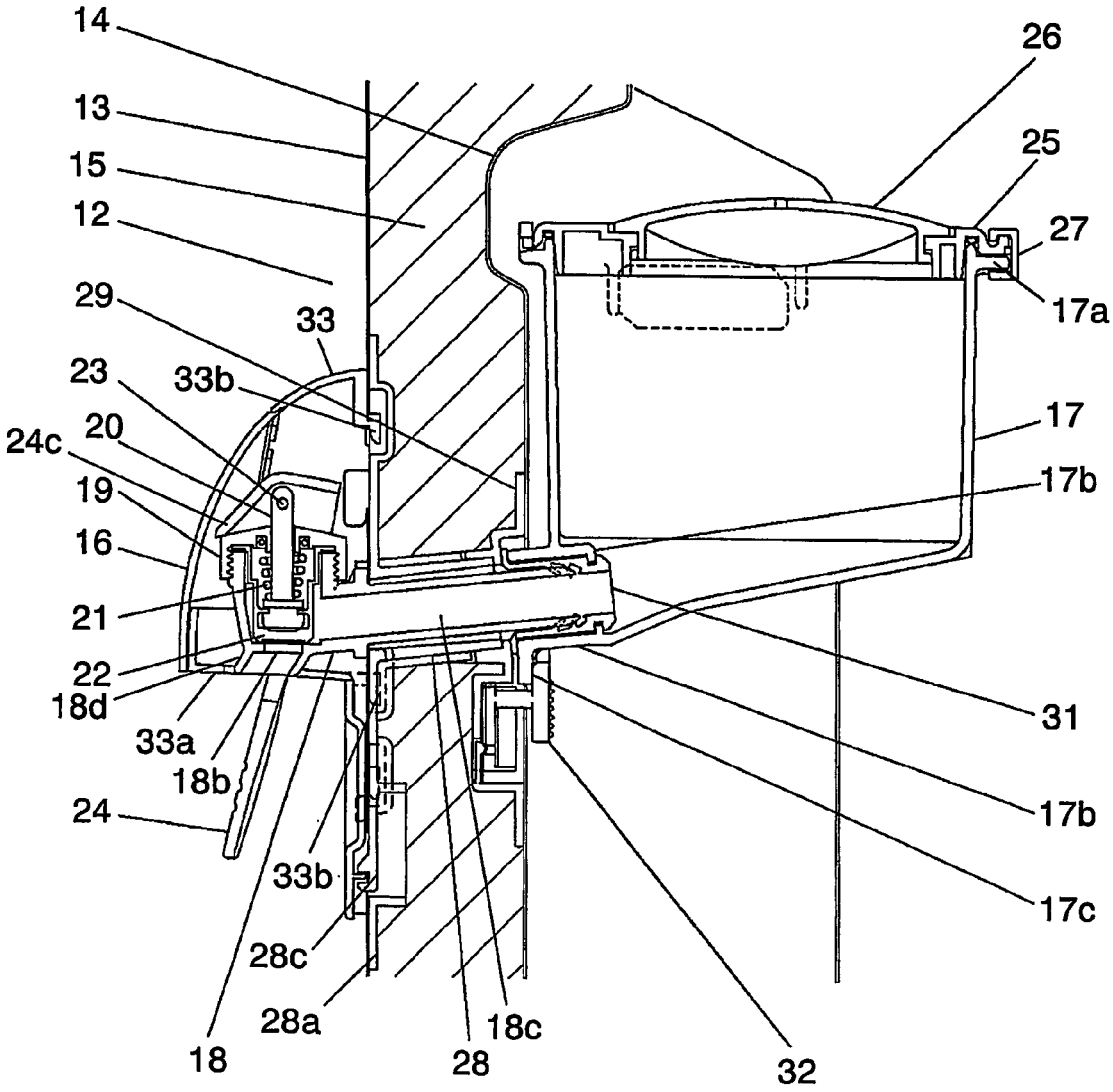
FIG. 2 shows a sectional view of a water feeder in accordance with an exemplary embodiment of the present invention.

In FIG. 1 and FIG. 2, door 12 of refrigerator 11 includes heat insulator 15 between its front face 13 and inner face 14. A water storage tank unit formed of water storage tank 17 and tank cover 25 is placed at a higher position of inner face 14. Water feeder 16 is placed on front face 13. The water storage tank unit is coupled to water feeder 16 by water feeding tube 18. Tank cover 25 is fixed at upper rib 17*a* of storage tank 17 by slide lever 27. Circular tank cap 26 is placed at a center section of tank cover 25. Lower projection 17*c* of storage tank 17 is fixed on inner face 14 by stopper 32.

Feeding tube 18 is inserted into guide 28 and holder 29 disposed in the heat insulator 15 in the door, so that tube 18 extends through door 12, and fixed to door 12 by a screw (not shown). A first end of feeding tube 18 sandwiches packing 31 made from soft rubber, and is coupled to discharge port 17*b* of storage tank 17. A second end of tube 18 projects from front face 13 and forms water feeder outlet 18*b*. Feeder outlet guide 18*d* slants forward, has a length of approx. 5 mm, and is flush with underside 33*a* of water feeder cover 33. Feeding tube 18 slants upward by 6° from water feeder 16 toward the storage tank unit, and has an inner diameter of 10 mm greater than the inner diameter of 9 mm of feeder outlet 18*b*.

Feeder cover 33 is fixed to front door face 13 by plural claws 33*b*, and vertically held by claw 28*c* and feeder base 28*a* that is unitarily mold with guide 28. A push of feeding lever 24 opens feeder outlet 18*b* of feeding tube 18, so that the water in storage tank 17 flows through feeder outlet 18*b*. Since feeder outlet guide 18*d* slants forward, a user can receive the water into a glass with ease. Feeding tube 18 has an inner diameter greater than that of feeder outlet 18*b*, so that the water flowing from outlet 18*b* flows at a steady speed. Since tube 18 slants upward, the water in tank 17 is discharged to the last drop into conduit 18*c*.

Water feeder 16 mounted on front door face 13 includes a water feed controlling unit for opening/closing feeder outlet 18*b*. The controlling unit comprises the following elements:

- canopy 19 mounted to tube 18 above feeder outlet 18*b*;
- sliding rod 20 extending through canopy 19 in a sliding manner;
- spring 21 placed on outer rim of rod 20;
- rubber lid 22 mounted to rod 20; and
- feeding lever 24 inked to sliding rod 20 via pin 23 above canopy 19.

Figure 3:
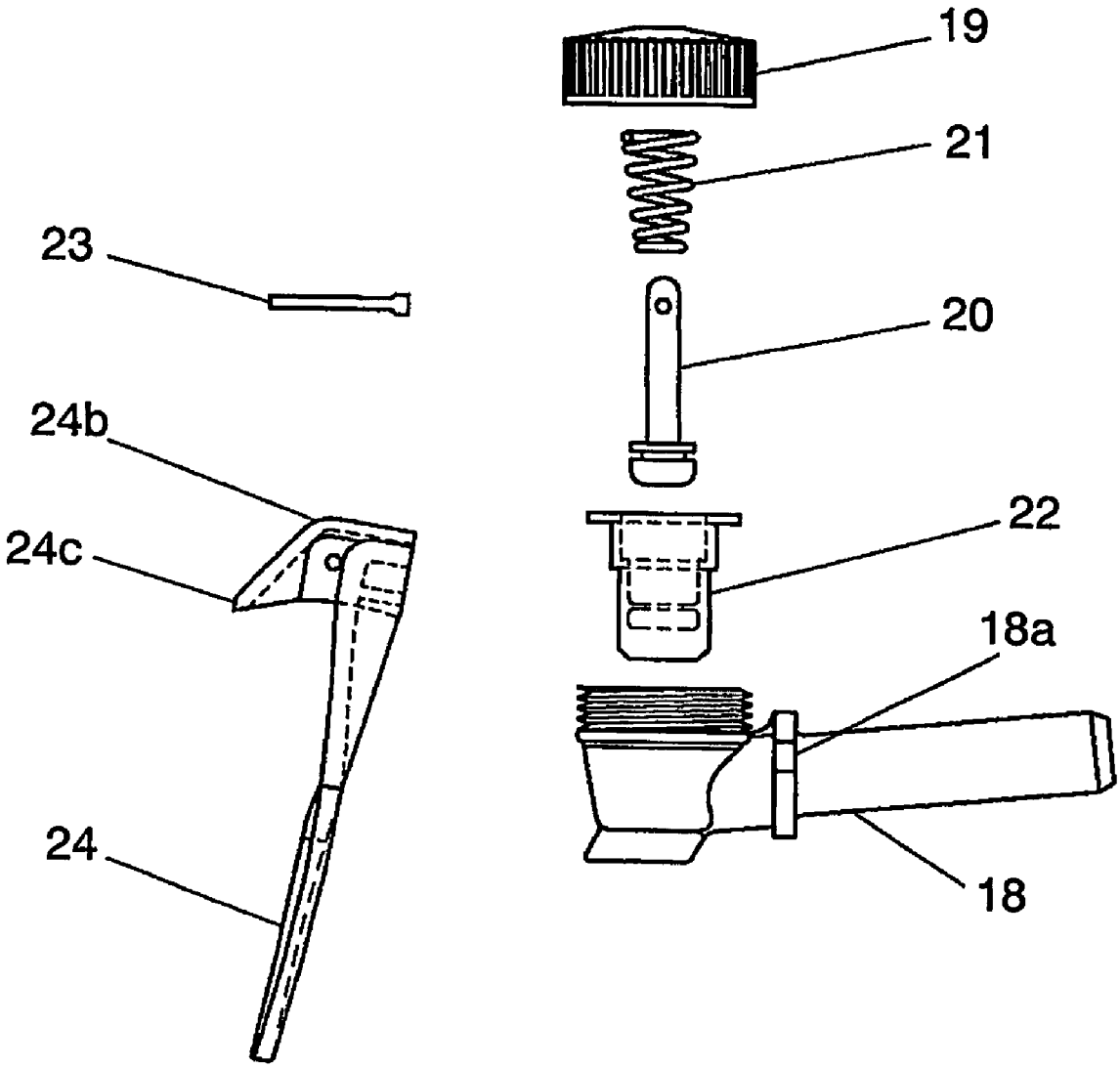
FIG. 3 shows an exploded view of elements forming a water feed controlling unit.
Figure 4:
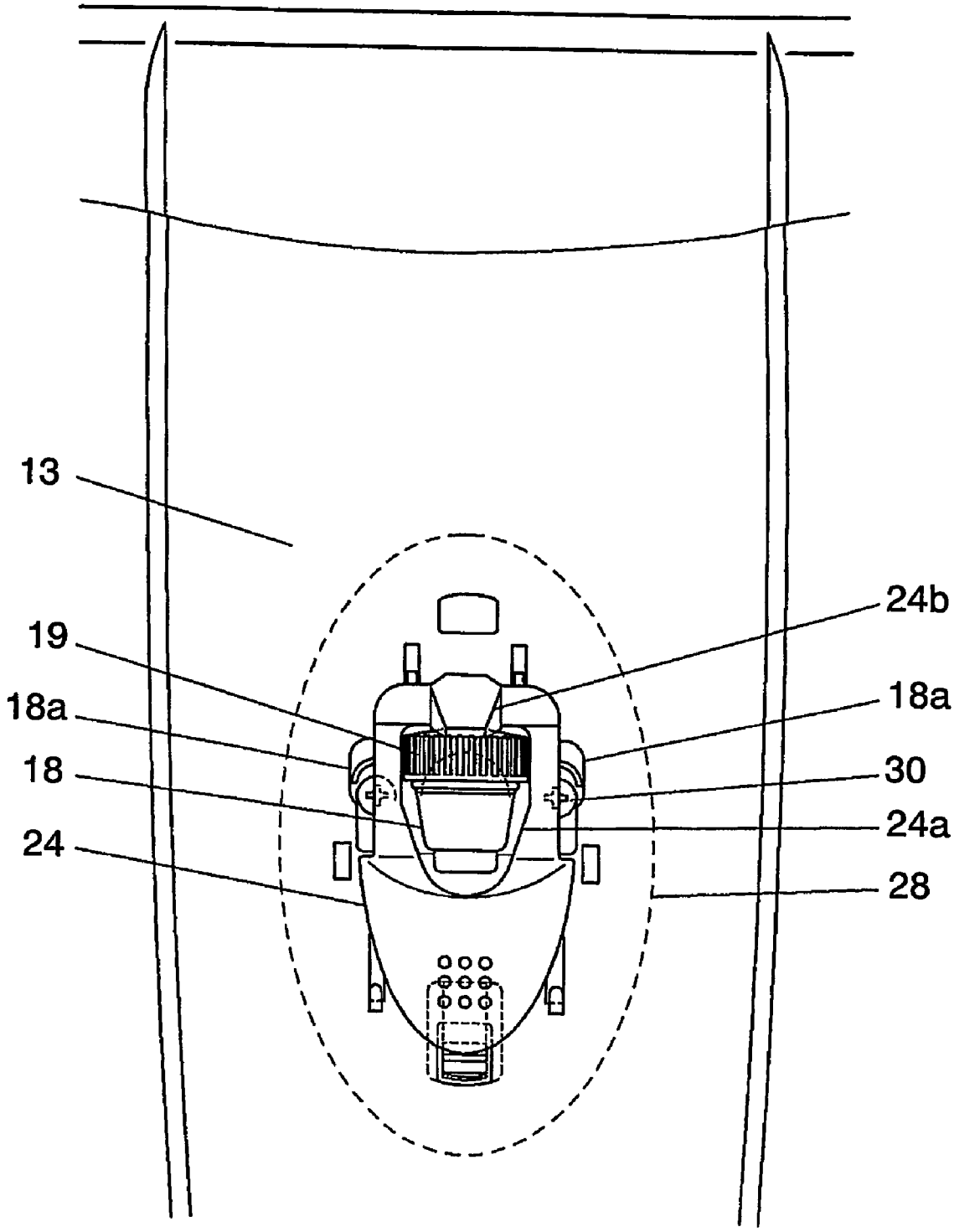
FIG. 4 shows a front view of a water feeding lever and a water feeding tube.
Figure 5:
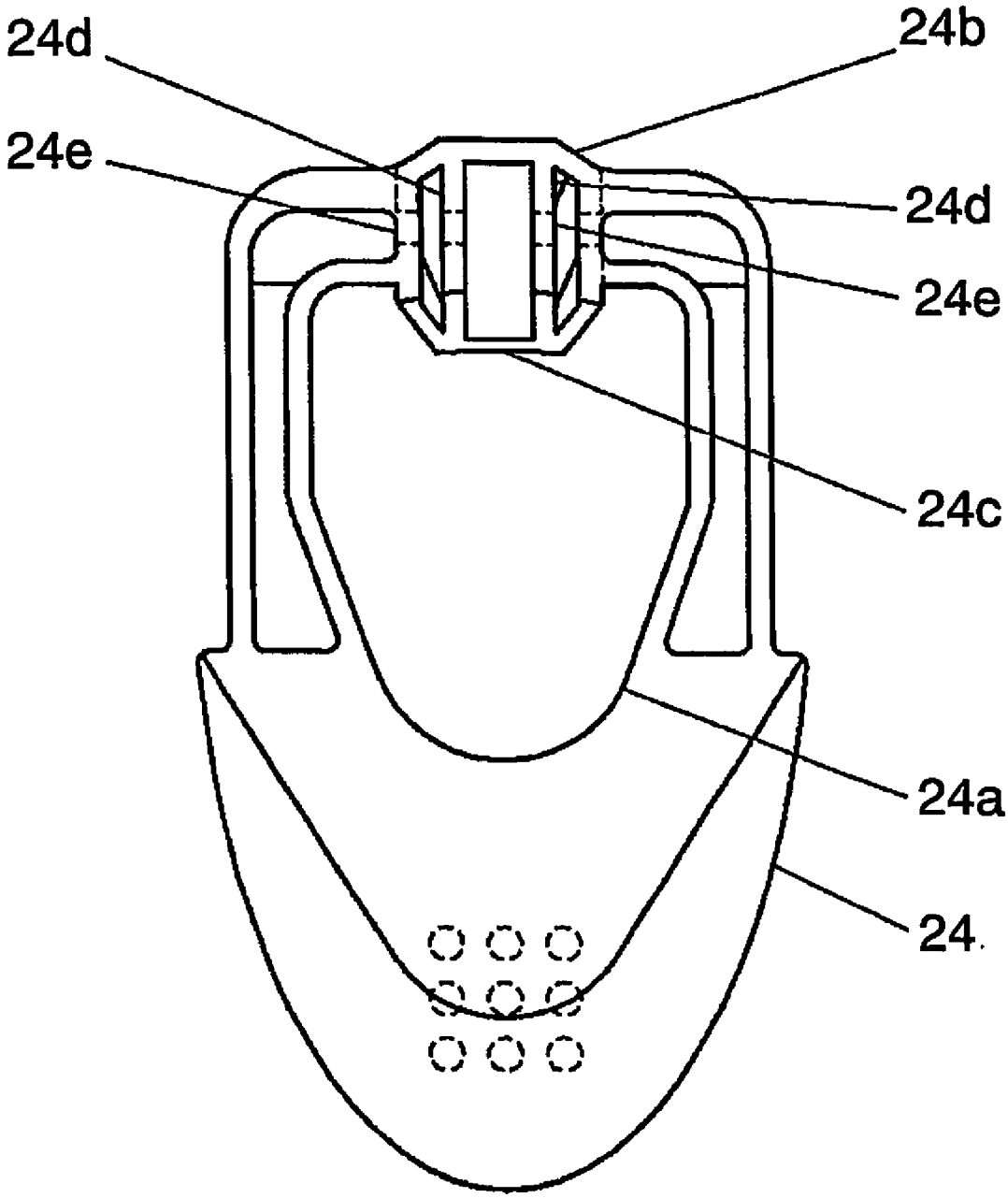
FIG. 5 shows a rear view of the water feeding lever.

FIG. 3 shows an exploded view of the water feed controlling unit. FIG. 4 shows a front view of feeding lever 24 and feeding tube 18. Feeding lever 24 has hole 24*a* at its center section and projection 24*b* at its upper section. Feeding tube 18 is placed in hole 24*a* free from interfering with lever 24. Tip 24*c* of projection 24*b* is brought into contact with canopy 19 (refer to FIG. 2.) FIG. 5 shows a rear view of feeding lever 24. Projection 24*b* includes dual ribs 24*d*-24*d* therein for holding sliding rod 20, and hole 24*e* is punched through projection 24*b* for pin 23 to be inserted.

A push of lever 24 of water feeder 16 (refer to FIG. 2) rocks lever 24 about tip 24*c* as a fulcrum, thereby moving pin 23 upward. At the same time, sliding rod 20 linked with pin 23 and rubber lid 22 also move upward. Spring 21 is thus compressed, so that feeder outlet 18*b* of feeding tube 18 is opened, and the water in storage tank 17 flows through outlet 18*b*.

Release of lever 24 depresses rod 20 and lid 22 due to repulsion of spring 21, so that outlet 18*b* is closed. The water cannot leak from outlet 18*b* because rubber lid 22 seals outlet 18*b* by the repulsion of spring 21.

Figure 6:
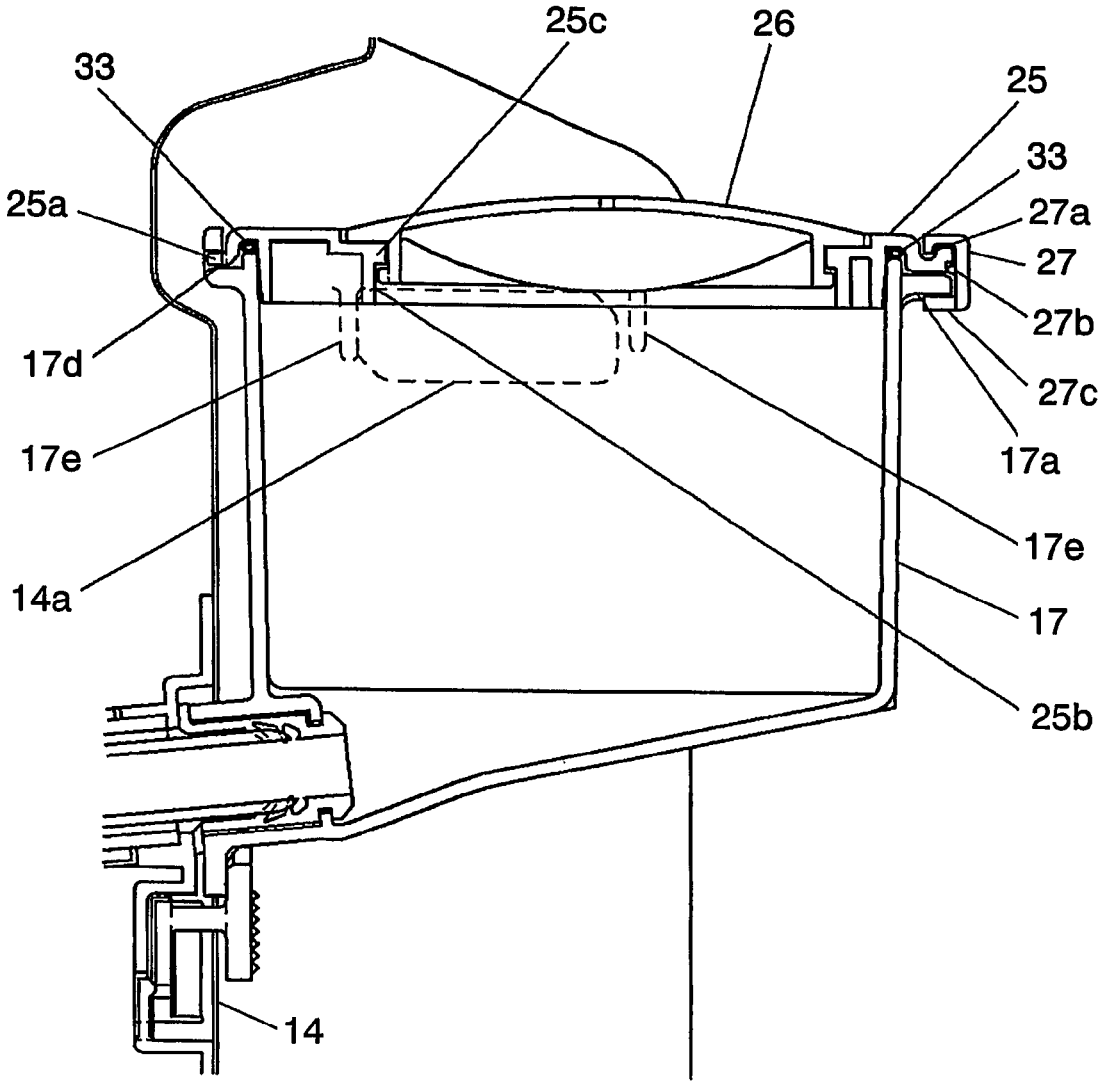
FIG. 6 shows an enlarged view of a water storage tank.
Figure 7:
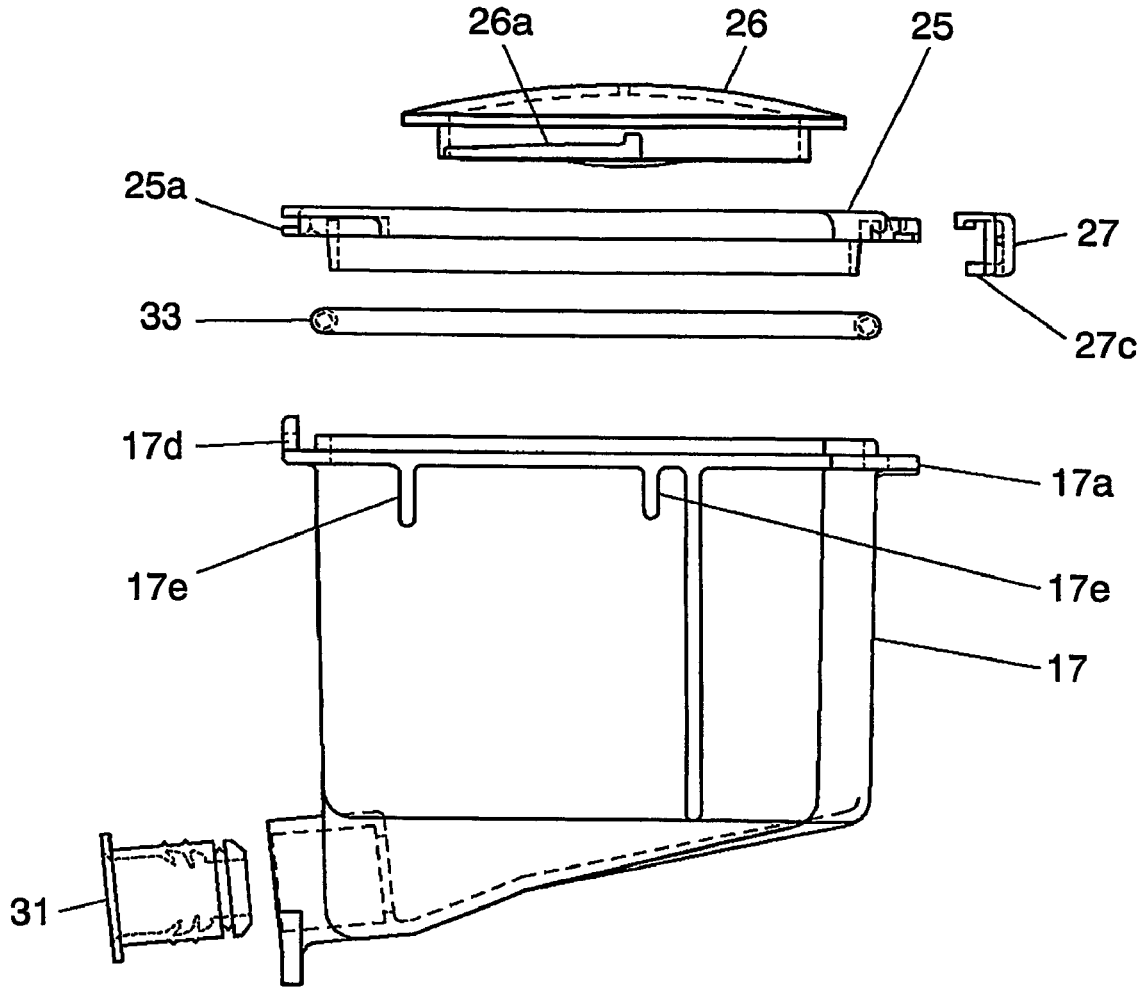
FIG. 7 shows an exploded view of the water storage tank.

FIG. 6 shows an enlarged view of the water storage tank unit, and FIG. 7 shows an exploded view of the water storage tank unit. Seal-packing 33 is disposed between tank 17 and tank cover 25, plural projections 25*a* disposed at the rear part of cover 25 are inserted in corresponding holes 17*d* of tank 17.

Slide lever 27 is mounted to the front face of cover 25 by projection 27*a* and rib 27*b*, lower rib 27*c* of lever 27 holds upper lib 17*a* of tank 17. Lever 27 can be downsized and divided into plural pieces (not shown).

Tank cap 26 closely engages with holes 25*b* of tank cover 25 because wedged rib 26*a* of tank cap 26 rotates to engage with intermittent ribs 25*c* disposed inside hole 25*b*. Tank cap 26 call be detached from tank 17 just by rotating cap 26, so that water can be supplied to tank 17 with ease.

Figure 8:
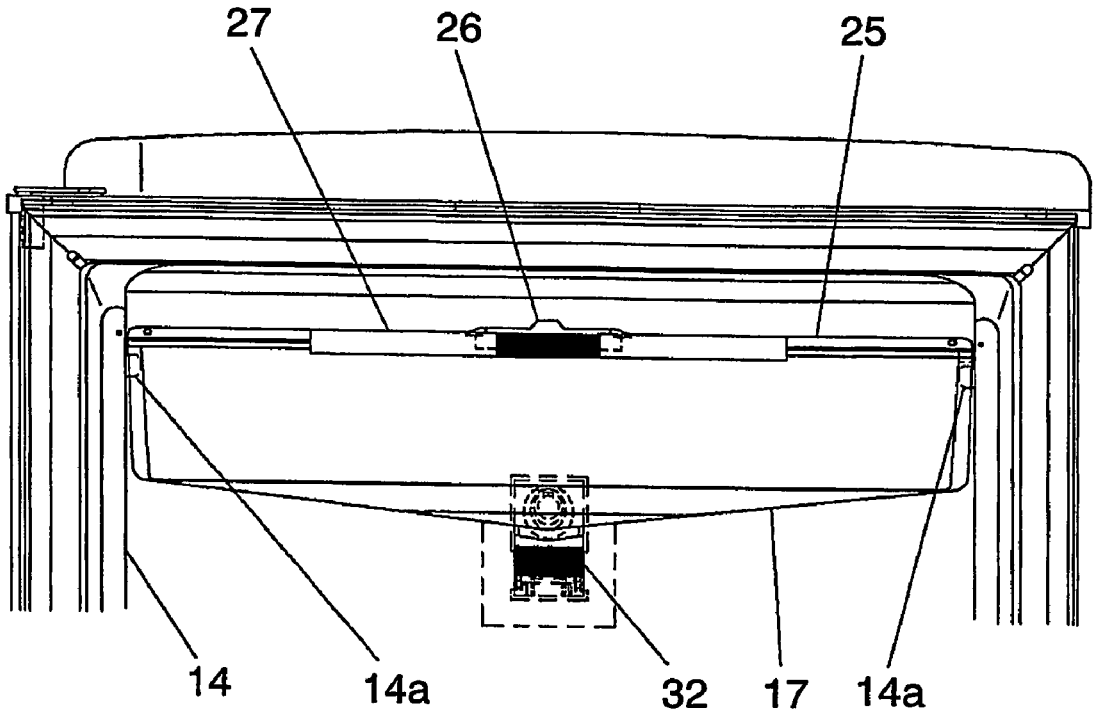
FIG. 8 shows a front view of the water storage tank mounted to the inside of the door.
Figure 9:
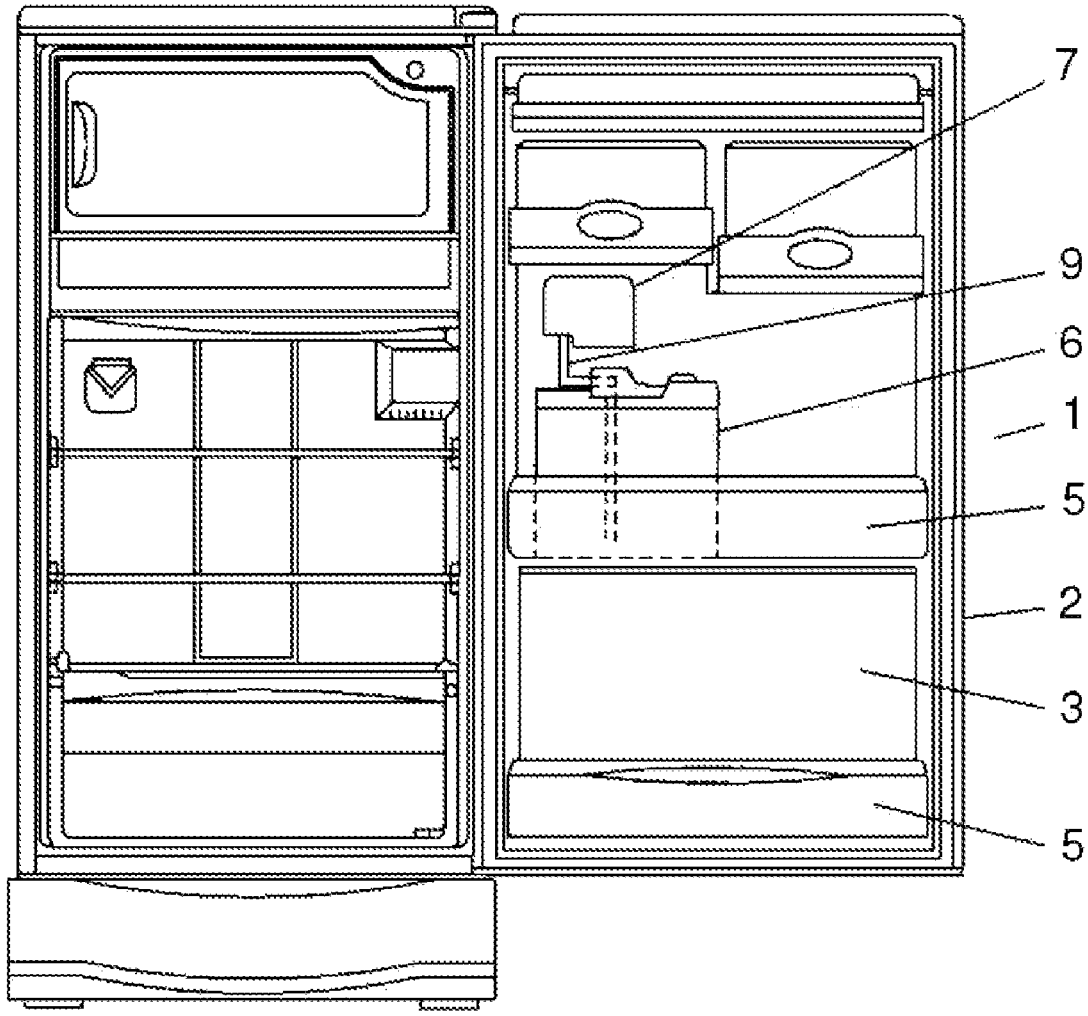
FIG. 9 PRIOR ART
FIG. 9 shows a front view illustrating the interior of a refrigerator having a conventional water feeder.

As shown in FIG. 8, storage tank 17 is mounted to projections 14*a*-14*a* disposed on both sides of inner door face 14, and positioned by guide lib 17*e* (refer to FIG. 7) of tank 17. The weight of tank 17 is born by projections 14*a*-14*a*. Lower projection 17*c* refer to FIG. 2) of tank 17, namely, a coupling section between tank 17 and feeding tube 18, is fixed to inner door face 14 by stopper 32.

As discussed above, the refrigerator of the present invention comprises the water storage tank unit placed at a higher place of the inner door-face, water feeder 16 disposed on front door-face 13, and feeding tube 18 coupling the storage tank unit to water feeder 16. Feeding tube 18 slants upward from water feeder 16 to the tank unit. This construction allows the water feeder to work without a pump, and enlarging the space inside of the refrigerator for storing food, also supplying water to storage tank 17 with ease. This construction also allows the water feeder to work even at a power failure.

INDUSTRIAL APPLICABILITY

The refrigerator having the water feeder of the present invention have the advantages discussed above, so that the refrigerator can be widely used.

The invention claimed is:

1. A refrigerator comprising:

a door filled with heat insulator therein;

a water storage tank unit disposed at a high place of an inner face of the door, and the water storage tank unit including a water storage tank and a tank cover;

a water feeder disposed on a front face of the door, a water feeder tube coupling the tank unit to the water feeder, and including a water feeder outlet at an end of the tube, the water feeder including a water feed controlling unit opening/closing the water feeder outlet, the water feed controlling unit includes:

a canopy mounted to the water feeding tube above the water feeder outlet;

a sliding rod extending through the canopy in a sliding manner;

a spring mounted on the sliding rod;

a rubber lid mounted to the sliding rod;

a pin; and a water feeding lever coupled to the sliding rod via the pin above the canopy; and wherein the water feeding tube slants upward from the water feeder to the tank unit, the water storage tank is fixed to a projection provided on the inner face of the door at its upper section, and lower projection of the tank, a coupling section between the tank and the feeding tube, is fixed to the inner face of the door by a stopper.

2. The refrigerator of claim 1 further comprising:

a water feeder cover for covering the water feeder; and a water feeder outlet guide for surrounding the water feeder outlet, wherein the guide slants forward, and a lower end of the guide is substantially flush with a lower end of the cover.

3. The refrigerator of claim 1, wherein the water feeding tube has a greater inner diameter than that of the water feeder outlet.

4. The refrigerator of claim 1, wherein the water storage tank is coupled to the water feeding tube by a packing made from soft rubber.

5. The refrigerator of claim 1, wherein the feeding lever of the water feed controlling unit includes a hole at a center section, and the feeding tube is placed in the hole of the lever free from interfering with the lever.

6. The refrigerator of claim 1, wherein the water feeding lever has a multi-rib structure which holds the pin of the water feed controlling unit.

7. The refrigerator of claim 1, wherein the door includes a guide member in the heat insulator, and the water feeding tube extends through the door via the guide member.

8. The refrigerator of claim 1, wherein the tank cover sandwiches a seal packing therein and is mounted to the water storage tank.

9. The refrigerator of claim 1, wherein the tank cover is fixed to the water storage tank by at least one slide lever.

10. The refrigerator of claim 1, wherein the tank cover is equipped with a rotary and circular tank cap.

* * * * *

UNITED STATES PATENT AND TRADEMARK OFFICE

CERTIFICATE OF CORRECTION

PATENT NO. : 7,418,828 B2
APPLICATION NO. : 10/595048
DATED : September 2, 2008
INVENTOR(S) : Nobuaki Himori It is certified that error appears in the above-identified patent and that said Letters Patent is hereby corrected as shown below:

Column 3

At line 7 of Claim 1, "feeder" should read -- feeding --.

Signed and Sealed this

Twenty-third Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,418,828 B2
APPLICATION NO. : 10/595048
DATED : September 2, 2008
INVENTOR(S) : Nobuaki Himori It is certified that error appears in the above-identified patent and that said Letters Patent is hereby corrected as shown below:

Column 3

Claim 1, line 36, “feeder” should read -- feeding --.

This certificate supersedes the Certificate of Correction issued December 23, 2008.

Signed and Sealed this

Twenty-seventh Day of January, 2009

JOHN DOLL
*Acting Director of the United States Patent and Trademark Office*